United States Patent [19]

Grabits

[11] Patent Number: 4,749,175

[45] Date of Patent: Jun. 7, 1988

[54] ARROW FLETCHING JIG

[76] Inventor: Joseph S. Grabits, 83741 County Line Rd., Cadiz, Ohio 43907

[21] Appl. No.: 44,350

[22] Filed: Apr. 30, 1987

[51] Int. Cl.[4] ..... B25B 1/20

[52] U.S. Cl. ..... 269/38

[58] Field of Search ..... 269/38, 296, 41, 82, 269/83

[56] References Cited

U.S. PATENT DOCUMENTS

| | | | |
|---|---|---|---|
| 1,896,536 | 2/1933 | Belshaw . | |
| 2,286,574 | 6/1942 | Rohde . | |
| 2,731,992 | 1/1956 | Lozon . | |
| 2,742,064 | 4/1956 | Quist . | |
| 2,748,459 | 6/1956 | Orr | 269/296 |
| 2,836,208 | 5/1958 | Hoyt, Jr. . | |
| 2,884,034 | 4/1959 | Portinga . | |
| 2,918,097 | 12/1959 | Thompson . | |
| 3,015,483 | 1/1962 | Martin . | |
| 3,024,017 | 3/1962 | Stanton . | |

*Primary Examiner*—Robert C. Watson

*Attorney, Agent, or Firm*—Daniel J. Hudak Co.

[57] ABSTRACT

An arrow fletching jig is provided for attaching feathers to an arrow shaft. The jig contains a base plate having thereon two upstanding end walls with each end wall having an opening therein to receive the arrow shaft. One of the upstanding end walls is distally attached to the base plate through a bracket and pivots about a pivot pin. The opening of the pivot wall, and hence arrow shaft, is thus capable of traveling in an arc about the pivot pin. Each end wall of the fletching jig has grooves therein for receiving a feather clamp. Utilization of the fletching jig permits the simultaneous application of two feathers to an arrow shaft, the application of a total of four feathers to a shaft, as well as the ability to use the same jig to apply left wing feathers or right wing feathers to a shaft.

15 Claims, 2 Drawing Sheets

FIG.-4
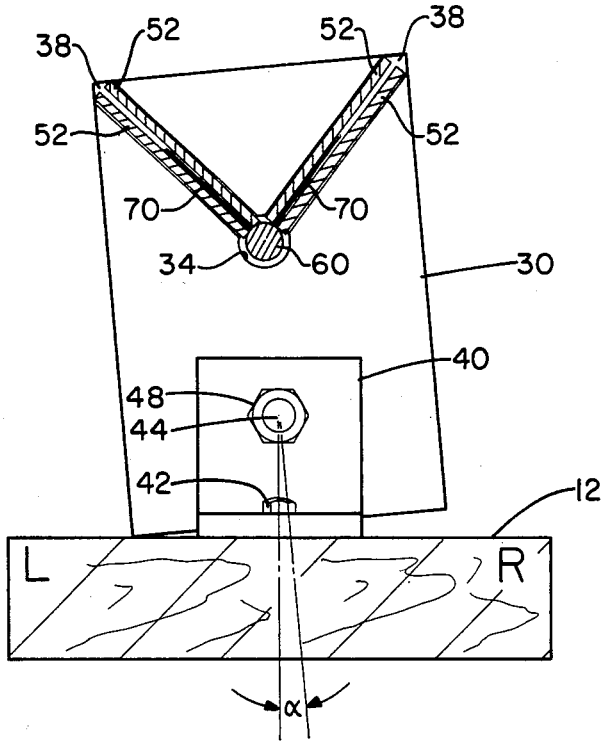
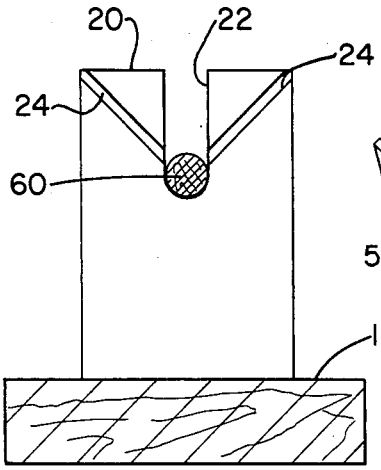
FIG.-5
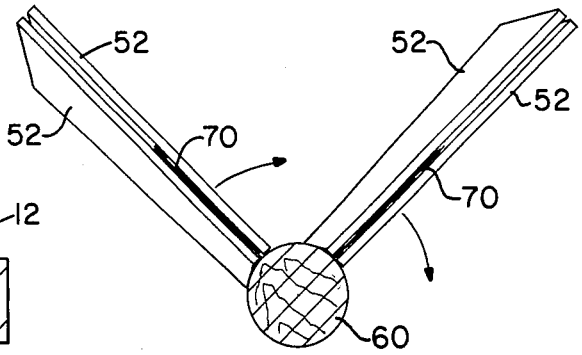
FIG.-6

ARROW FLETCHING JIG

FIELD OF THE INVENTION

The present invention relates to a fletching jig for conveniently applying either left wing or right wing feathers to an arrow shaft as well as to applying a total of four feathers thereto.

BACKGROUND

Arrows have existed since before the dawn of history. The accurate placement and alignment of feathers on a shaft has long been a problem. Accordingly, numerous devices have been utilized over the centuries to apply feathers to a shaft. Some of the very recent devices have been patented.

For example, U.S. Pat. No. 1,896,563 to Belshaw relates to an arrow fletching machine in which horizontal movable bars operate in conjunction with an indexed wheel.

U.S. Pat. No. 2,286,574 to Rohde relates to a fletching jig adapted to high speed production of accurately feathered arrows.

U.S. Pat. No. 2,731,992 to Lozon relates to a fletching fixture containing a supporting structure for rotatably supporting the shaft of an arrow so that the shaft can be turned in a plurality of selective positions to have feathers applied thereto in circumferentially arranged positions.

U.S. Pat. No. 2,742,064 to Quist relates to a fletching device for holding the shaft of an arrow in position for receiving feathers and to another device for applying a feather to the shaft.

U.S. Pat. No. 2,836,208 to Hoyt relates to a universally adapted jig to accurately position and hold a plurality of either right or left wing feathers for either straight or spiral style fletching.

U.S. Pat. No. 2,884,034 to Portinga relates to a fletching jig which is adjustable to accomodate the fletching of feathers upon arrows in various degrees of spiralling in either a clockwise or counterwise direction about a shaft.

U.S. Pat. No. 2,918,097 to Thompson relates to a fletching jig for positioning the feathers on the shaft of arrows, either parallel with the shaft or an angle to the shaft.

U.S. Pat. No. 3,024,017 to Stanton relates to providing a rigid, nonadjustable fletching jig which permits the application of an adhesive directly to the arrow shaft through the use of a slim nozzle.

U.S. Pat. No. 3,015,483 to Martin relates to a fletching jig which allows fletches to be applied to the arrow shaft at desired angular locations.

SUMMARY OF THE INVENTION

It is therefore an aspect of the present invention to provide a fletching jig for applying either left wing or right wing feathers to a shaft thereby forming an arrow.

It is another aspect of the present invention to provide a fletching jig, as above, wherein two feathers are simultaneously applied to a shaft and wherein a total of four feathers are applied to a shaft.

It is a further aspect of the present invention to provide a fletching jig, as above, wherein an end wall having an opening therein is pivotally and distally attached to a base plate.

It is yet another aspect of the present invention to provide a fletching jig, as above, wherein said end wall opening is capable of receiving a shaft of an arrow and wherein said arrow shaft is rotatable through an arc upon movement of said pivotable end wall.

It is a still further aspect of the present invention to provide a fletching jig, as above, wherein upstanding end walls have grooves therein for accomodating a feather clamp.

These and other aspects of the present invention will become apparent from the following detailed description.

In general, a fletching jig for supporting an arrow shaft and applying feathers thereto comprises a base plate, a noch end wall and a shaft end wall attached to said base plate, each said end wall having an opening for engaging the shaft of an arrow, one of said end walls distally located from said base plate and pivotally attached thereto through a pivot pin so that said end wall opening is movalbe in an arc about said pivot pin.

BRIEF DESCRIPTION OF THE DRAWINGS

FIG. 4 is an elevational view taken on line 4—4 of FIG. 2;

FIG. 5 is an elevational view taken on line 5—5 of FIG. 2; and

FIG. 6 is an elevational view of an arrow from the rear end illustrating the twisted clamp plates for mounting two feathers for a left wing arrow.

DETAILED DESCRIPTION OF THE INVENTION

Figure 1:
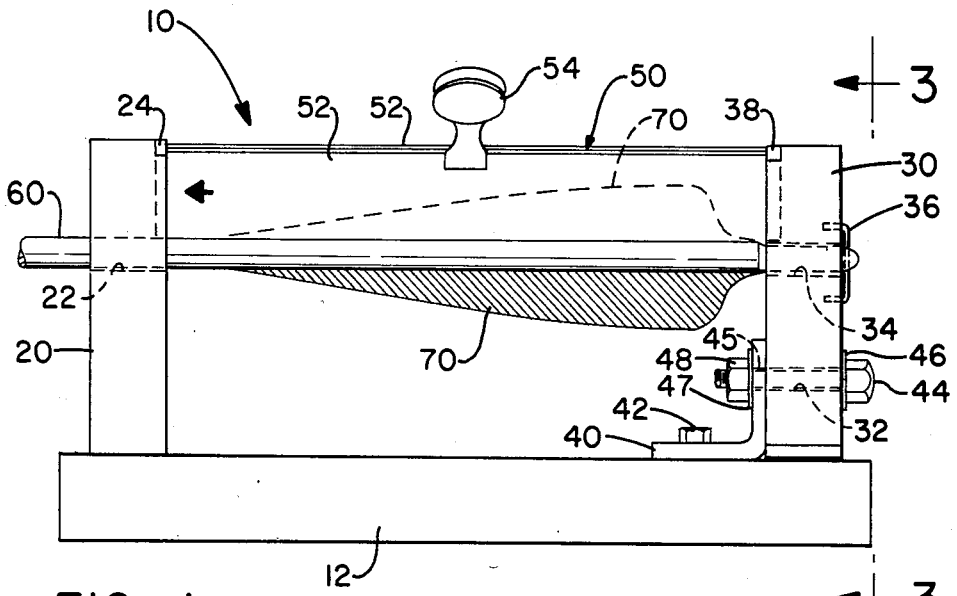
FIG. 1 is a side elevational view of the apparatus.

The fletching jig of the present invention is generally indicated by the numeral 10. The jig has a base plate 12 which can be made out of any suitable material such as plastic, metal, or wood, and can be of any shape such as rectangular. An upstanding shaft wall 20 resides on one end of the base plate and extends upwardly therefrom. Another upstanding wall 30, hereinafter referred to as a noch upstanding wall, also resides on the base plate at the other end thereof and also extends upwardly therefrom. However, as will be more fully explained hereinbelow, noch upstanding wall 30 is distally and pivotally attached to the base through bracket 40.

As seen in FIG. 1, bracket 40 has anchor screws 42 extending into the base plate so that it is secured thereto. Bracket 40, which in the preferred embodiment is in the form of an angle although it can exist in other conventional shapes, has a pivot pin 44 extendiing through aperture 45 thereof. The pivot pin can be a bolt or any other suitable in permitting noch wall 30 to pivot thereabout. Exterior washer 46 and interior washer 47 are located upon their respective sides of noch wall 30. Bolt 44 extends through aperture 45 and is secured to brakcet 40 through fastener 48 which can be a nut. When it is desired that noch wall 30 be positioned in one orientation or another, that is a left wing orientation or a right wing orientation, the fastener is loosened, the noch wall moved to the desired orientation and the fastener tightened. Noch wall 30 is desirably pivotally attached to pivot pin 44 at a distance or location such that the bottom of the end wall is distally located or spaced apart from the base plate and thus can pivot about pivot pin 44. The distal distance is rather small so that the "alpha" angle, that is the angle of rotation of the noch wall from a vertical position to either a left wing position or a right wing position, (the distance the bottom side corner of the noch wall moves from a horizontal position before it contacts the base plate), is 15 degrees or less, desirably 7 degrees or less, and preferably 5 degrees or less as from about 3 to about 5 degrees. The distal distance and location of the pivot pin thus determines the "alpha" angle and can be readily calculated. As will be more fully explained hereinbelow, the "alpha" angle determines the degree of feather rotation along the arrow shaft. Should the angle of rotation be desired to be reduced, a shim, etc., can be installed on the base plate.

Figure 2:
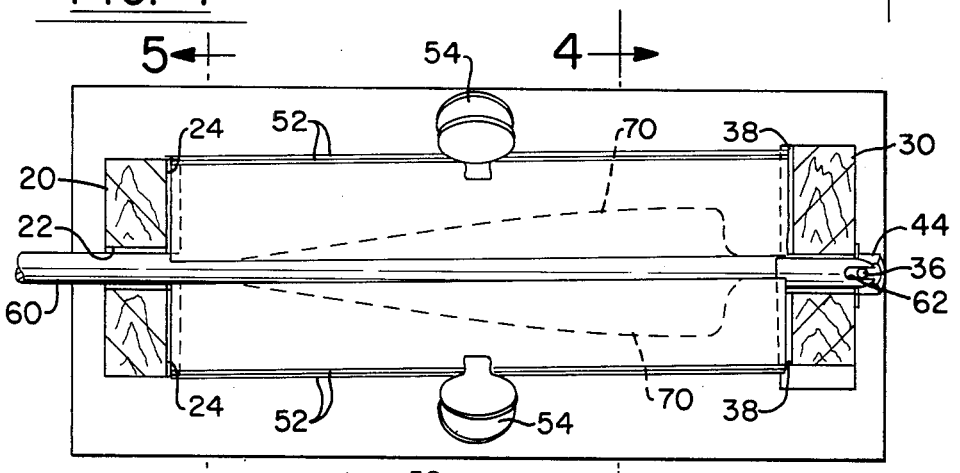
FIG. 2 is a top view, partially broken away to reveal various features of the end blocks.
Figure 3:
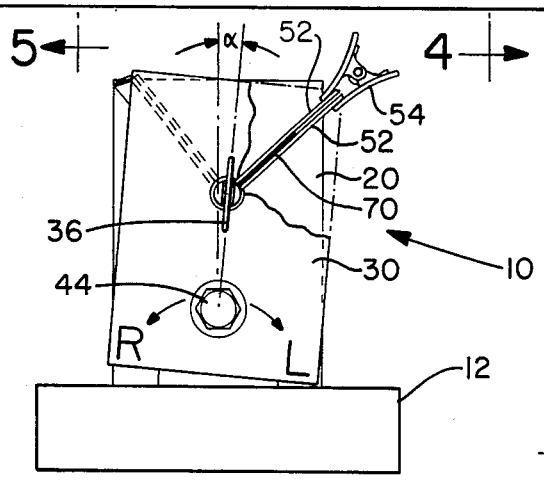
FIG. 3 is an end view as may be taken on line 3—3 of FIG. 1 and partially broken away to reveal the mounting arrangement of feather holding plates for a left wing arrow.

The upstanding walls can be made of any suitable material such as wood, steel, plastic, or the like. They are located at a distance from one another such that an arrow shaft 60 can reside therebetween and sufficient space exists to receive feathers from the fletching jig. Considering shaft wall 20, it can be attached to the base plate in any conventional manner as through the use of fasteners, adhesives, or the like. Shaft wall 20 has a slot 22 which generally extends vertically downward and is of a sufficient size to receive the shaft of an arrow. Noch wall 30 has an opening or aperture 34 therein to receive the noch portion of an arrow shaft. Furthermore, as shown in FIGS. 1, 2, and 3, a noch pin 36 resides on the exterior surface of the noch wall and is adapted to receive the noch of the arrow shaft. The provision of a noch pin thus prevents the shaft from rotating during the fletching operation.

Feather 70, which is applied to shaft 60, can be any conventional feather and made from plastic, or more desirably, be a genuine feather as from a turkey, with the vanes thereof extending in a rearwardly direction. The fletches are applied through the utilization of clamp 50 which can be made of metal, plastic, etc. Clamp 50 generally has two plates 52 which are connected together through handle clip 54. The handle clip is generally integrally attached to each plate and biasly engages the same as through the use of a spring so that the plates can be open, that is moved apart, and closed with respect to one another. A feather is inserted in the clamp between plates 52 with the vanes extending in the appropriate direction and the feather applied to the arrow shaft through the use of a suitable adhesive. The plane of the plates is not flat but rather is skewed or twisted depending upon whether a left wing fletching or a right wing fletching is to be applied. By the term "left wing fletching or feather", it is meant that the plane of the plates rotates counter clockwise in a direction proceeding from the rear of the plate to the forward edge of the plate. Thus, the applied feather will also be skewed in a counter clockwise direction in a direction proceeding from the rear of the feather to the leading edge thereof. Thus, when a plurality of fletches are attached to arrow shaft 60, the arrow, when in flight, will rotate in a counter clockwise direction when viewed from the tail (feather) end of the arrow.

With respect to a right wing fletching or feather, a similar clamp is utilized having two plates thereon and a handle clip with the exception that the plane of the plates, when viewed from the tail end thereof, that is in a direction proceeding towards the front of the arrow, is skewed or twisted in a clockwise direction. The applied feather will thus also be applied in a clockwise direction, in a direction proceeding from the rear of the feather to the leading edge thereof, and thus the arrow, during flight, will rotate in a clockwise direction when viewed from the tail end of the arrow.

According to an aspect of the present invention, a plurality of feathers is applied to the arrow shaft. A plurality of feathers, usually two, are generally simultaneously applied to the shaft, that is during the same fletching operation. A total of four feathers is desirably applied to the shaft according to the present invention.

Shaft wall 20 has two grooves located on the interior wall surface thereof which extend downwardly at an angle to the bottom of slot 22. Each groove 24 can exist at an angle with respect to the vertical such as about 40 degrees. Thus, when two fletches are applied to the arrow, they will exist with respect to one another at an angle of approximately 80 degrees. Grooves 22 need not be symetrically located with respect to the arrow shaft, that is at an angle of 45 degrees from the vertical, inasmuch as each feather need not be applied to the shaft at a 90 degree angle with respect to each other. In fact, it is desirable that the feathers be unevenly spaced in pairs so that the "flat" side of the feather can be laid upon the bow and the arrow thus encounters less resistance than otherwise when released from the bow. Of course, the noch pin 36 is applied in a vertical position thus ensuring upon the application of feathers to shaft 60 that the feathers encountering the bow will be the flat side of the feathered arrow.

The noch wall also has grooves 38 on the interior surface thereof which extend to the center of shaft opening 34. The grooves are desirably at the same angle with respect to the vertical as the grooves of the shaft wall. Thus, in the particular embodiment shown, each of the two grooves 38 are located in a noch wall at a 40 degree angle from the vertical. Hence, when noch wall 30 is aligned in a vertical position, the grooves thereof will be alignment with grooves 24 of the shaft wall. In other words, the grooves would be in a nonrotation alignment with regard to one another. Through the provision of pivot pin 44, noch end wall 30 can rotate about an arc (alpha) about the pivot pin. Thus, arrow shaft opening 34 also rotates through an arc about the pivot pin. Depending upon whether a left wing fletching or a right wing fletching is desired to be attached to the shaft, noch wall 30 can be rotated either in a counter clockwise direction or in a clockwise direction from a vertical position. Since in the depicted embodiment of the present invention, left wing feathers are applied to the arrow such that it rotates in a counter clockwise direction during flight, when viewed from the rear, the noch end wall is, as seen in FIG. 3, rotated in a clockwise direction until the bottom right hand corner portion contacts the base plate. The angle of rotation will be "alpha" degrees, which preferably will be 3 or 5 degrees. As previously noted, clamp plates 52 are also skewed. Desirably, they are skewed the same number of degrees as the "alpha" angle so that the ends of the clamp plates are matingly received or matingly engage the shaft wall grooves as well as the noch wall grooves. An adhesive is then applied to the base of the fletching or to the shaft, or to both, and the clamp allowed to rest upon the shaft for a suitable period of time so that the base of the feather is adhered to the arrow shaft. In the left wing embodiment shown, the feather will be skewed in a counter clockwise direction proceeding from the rear of the air feather to the forward end of the feather, that is towards the feather tip. Thus, when in flight, the arrow will rotate in a counterclockwise direction.

When a right wing fletching is desired, noch wall 40 is merely rotated in a counter clockwise direction as shown in FIG. 3, and the right wing clamp plates containing a feather therein inserted into the grooves of both the shaft wall and the noch wall. Once again, the clamp plates will be skewed but for a right wing arrow, they will be skewed in a clockwise direction proceeding from the rear of the arrow to the forward end thereof. The feathers thus applied will rotate "alpha" degrees in a clockwise direction such that the arrow in flight will rotate in a clockwise direction when viewed from the rear.

Inasmuch as the left wing clamps are skewed in a different direction than the right wing clamps, it should be apparent that the left wing clamps simply cannot fit into the jig when it is aligned for a right wing fletching and vice versa.

Once two feathers have been applied, the arrow is rotated 180 degrees and the remaining two feathers applied. Naturally, only all left wing feathers or all right wing feathers are applied to the same arrow shaft.

Although the noch end wall has been described as being pivotally attached to the base plate, it is to be understood that it is within the concepts of the present ivnention that the noch end wall can be securely attached to the base plate and that the shaft end wall can be pivotally attached thereto. The result will be the same, that is the generally simultaneous application of two fletches to an arrow shaft with the fletches being either right wing or left wing.

It should thus be apparent that the fletching jig of the present invention readily provides the simultaneous application of two fletches to an arrow shaft of a four feathered arrow, reeadily provides for the application of left wing feathers or right wing feathers thereto, and yet is easy to use.

While in accordance with the Patent Statutes, a best mode and preferred embodiment has been set forth, the scope of the invention is not limited thereto, but rather by the scope of the attached claims.

What is claimed is:

1. A fletching jig for supporting an arrow shaft and applying feathers thereto, comprising:

a base plate, a noch end wall and a shaft end wall attached to said base plate, each said end wall having an opening for engaging the shaft of an arrow, said noch end wall and said shaft end wall sufficiently spaced apart from each other so that a plurality of feathers are capable of being applied therebetween to said shaft, at least on groove in said noch end wall, at least one groove in said shaft end wall, said groove in said noch end wall engaging said noch end wall opening, said groove in said shaft end wall engaging said shaft end wall opening, said noch end wall groove existing at an angle with respect to the vertical of said noch wall, and said shaft groove existing at an angle with respect to the vertical of said shaft wall, one of said end walls distally located from said base plate and pivotally attached thereto through a pivot pin so that said end wall opening is movable in an arc about said pivot pin, a bracket, said bracket attached to said base plate, said pivot pin attached to said bracket and to said pivotable wall, and said non-pivotable end wall fixably attached to said base plate, said pivotal end wall capable of pivoting in a clockwise or a counter clockwise direction so that a left wing feather or a right wing feather can be applied to said shaft.

2. A fletching jig according to claim 1, wherein said pivotable end wall from a vertical position is capable of being rotated an angle of 15 degrees in either said clockwise direction or said counter clockwise direction.

3. A fletching jig according to claim 2, wherein the angle of said noch end wall groove and the angle of said shaft end wall groove are approximately the same.

4. A fletching jig according to claim 2, including a clamp, said clamp capable of holding a feather therein, said clamp being skewed so that it engages said noch end wall groove and said shaft end wall groove when said pivotal end wall is rotated in one direction.

5. A fletching jig according to claim 3, wherein said noch end wall has two grooves therein, wherein said shaft end wall has two grooves therein, wherein both of said noch end wall grooves engage said noch end wall opening, wherein said both of shaft end wall grooves engage said shaft end wall opening, including two skewed clamping members, each said clamping member capable of engaging one of said noch end wall grooves and a corresponding shaft end wall groove.

6. A fletching jig according to claim 3, wherein said noch end wall is said pivotal end wall and wherein said noch end wall is pivotal 7 degrees or less.

7. A fletching jig according to claim 2, wherein each of said two clamping plates is capable of being generally simultaneously applied to said shaft so that said feathers are generally simultaneously applied thereto.

8. A fletching jig according to claim 1, wherein said jig is capable of applying four feathers to said shaft.

9. A fletching jig according to claim 3, wherein said jig is capable of applying four feathers to said shaft.

10. A fletching jig according to claim 5 wherein said jig is capable of applying four feathers to said shaft.

11. A combination left wing or right wing fletching jig for applying at least one fletch to an arrow shaft, comprising:

a base plate, a noch wall, said noch wall having an opening therein capable of receiving the noch portion of an arrow shaft, said noch end wall rotatably attached to said base plate, a shaft end wall, said shaft end wall having an opening for engaging the shaft of an arrow, said noch end wall having at least one groove therein, said groove existing at an angle with respect to the vertical of said noch end wall and engaging said noch end wall opening, said shaft end wall having at least one groove therein, said shaft end wall groove existing at an angle with respect to the vertical of said shaft end wall and engaging said shaft end wall opening.

12. A fletching jig according to claim 1, wherein said noch end wall is distally attached to said base palte.

13. A fletching jig according to claim 1, including a bracket, said bracket attached to said base plate, wherein said noch end wall is pivotably attached to said bracket, and wherein each said groove is capable of receiving an end of a skewed feather clamp when said noch end wall is in a rotated position.

14. A fletching jig according to claim 1, wherein said noch end wall has a second groove therein, wherein said second groove exists on an angle with respect to the vertical of said noch end wall and engages said end wall opening, wherein said shaft end wall has a second groove therein, wherein said second shaft end wall groove exists at an angle with respect to the vertical of said shaft wall and engages said shaft wall opening, and wherein each said second groove is capable of receiving an end of a skewed feather clamp when said noch end wall is in a rotated position.

15. A fletching jig according to claim 1, wherein two feathers can be simultaneously applied to an arrow shaft.

* * * * *